United States Patent [19]

Wood, Jr.

[11] Patent Number: 4,648,526

[45] Date of Patent: Mar. 10, 1987

[54] SAFETY CAP FOR A PRESSURIZED CYLINDER

[75] Inventor: Theodore N. Wood, Jr., Harveys Lake, Pa.

[73] Assignee: The Eastern Pennsylvania Co., Inc., Wilkes-Barre, Pa.

[21] Appl. No.: 817,485

[22] Filed: Jan. 9, 1986

[51] Int. Cl.[4] ..... B65D 41/06

[52] U.S. Cl. ..... 220/85 P; 137/382

[58] Field of Search ..... 220/85 P, 3, 323, 324, 220/326, DIG. 20; 137/377, 382

[56] References Cited

U.S. PATENT DOCUMENTS

| | | | |
|---|---|---|---|
| 104,884 | 0/1870 | Reinshagen . | |
| 207,979 | 0/1878 | Pearson . | |
| 235,279 | 0/1880 | Norton . | |
| 1,216,869 | 2/1917 | Snigo . | |
| 1,833,924 | 12/1931 | Wayer | 137/382 |
| 1,948,953 | 2/1934 | Wayer et al. . | |
| 2,201,521 | 5/1940 | Cook et al. | 220/85 P |
| 2,216,717 | 10/1940 | Alessio . | |
| 3,185,336 | 5/1965 | Goss | 220/85 P |
| 3,696,964 | 10/1972 | Deakin . | |
| 3,706,401 | 12/1972 | Gach . | |
| 3,831,802 | 8/1974 | Chambers et al. | 137/382 X |
| 4,279,355 | 7/1981 | Schwartz et al. . | |
| 4,491,060 | 1/1985 | Boski . | |

FOREIGN PATENT DOCUMENTS

| | | |
|---|---|---|
| 84821 | of 1895 | Fed. Rep. of Germany . |
| 750819 | 1/1945 | Fed. Rep. of Germany . |

*Primary Examiner*—Steven M. Pollard

*Attorney, Agent, or Firm*—Burns, Doane, Swecker & Mathis

[57] ABSTRACT

A pressurized cylinder has a cap mounted thereto by a coupling comprising tabs in the cap which are rotatable within an annular groove carried by the cylinder. Stops are provided which limit rotation of the cap in both directions once the cap is installed. One of the stops comprises a movable latch which can be released to permit the cap to be removed by rearward rotation. The tabs are loosely disposed within the groove to minimize chances of the tabs becoming rusted thereto. The tabs are of elongate dimension in the circumferential direction to maximize the resistance to inadvertent dislodgement of the cap. The tabs are formed separately of the cap and are mounted within slits formed in a ductile wall of the cap to render the arrangement more shock resistant.

21 Claims, 15 Drawing Figures

Fig. 1
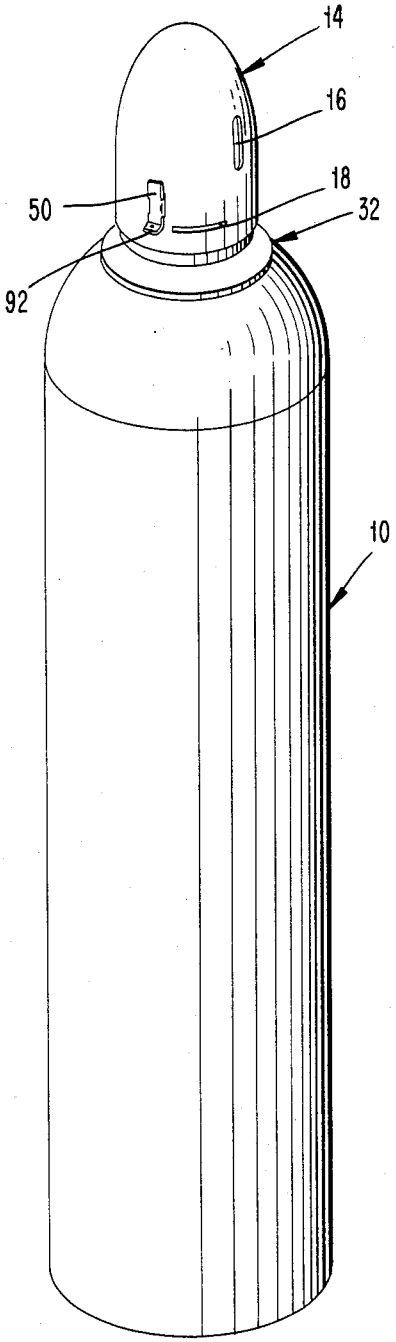
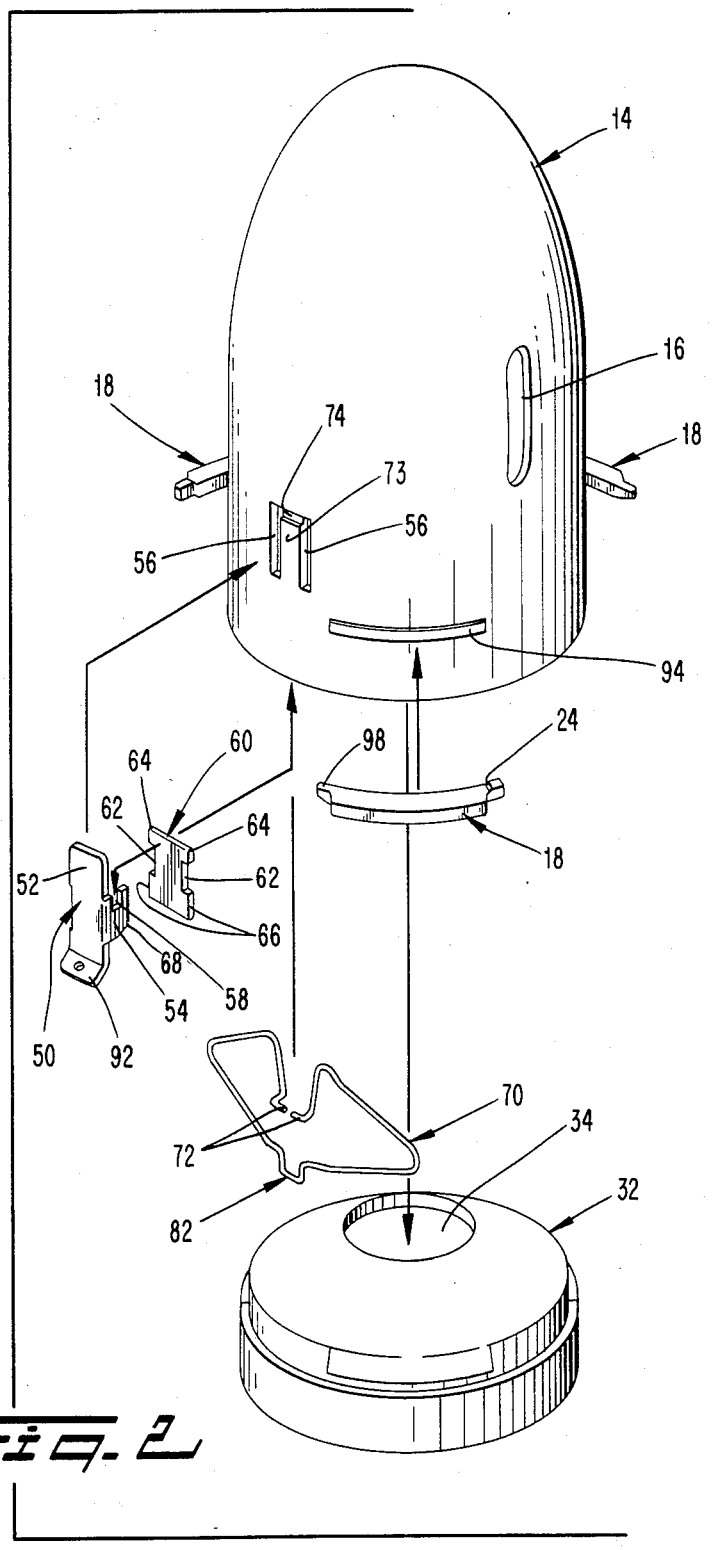
Fig. 2

Fig. 8
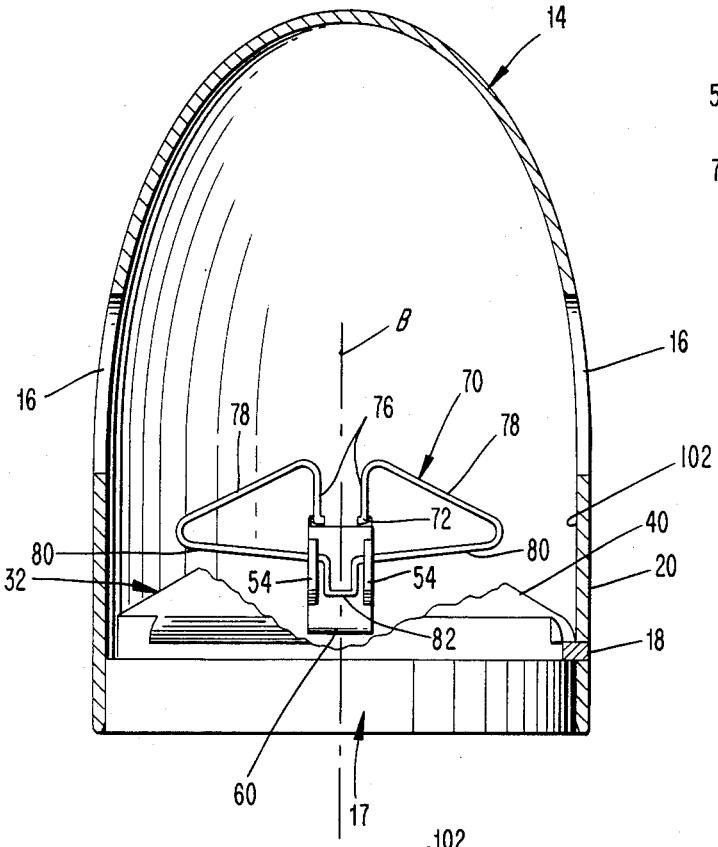
Fig. 11
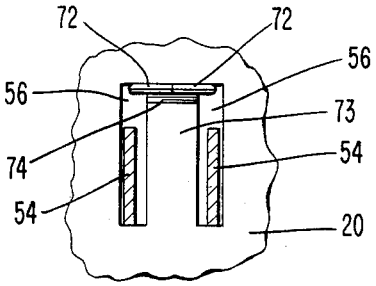
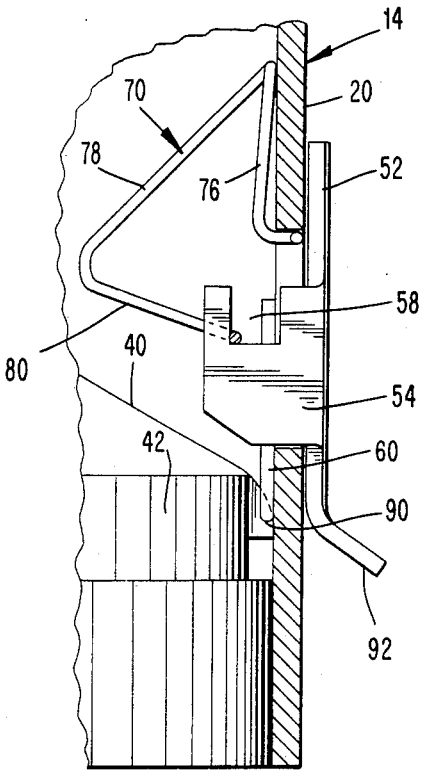
Fig. 10
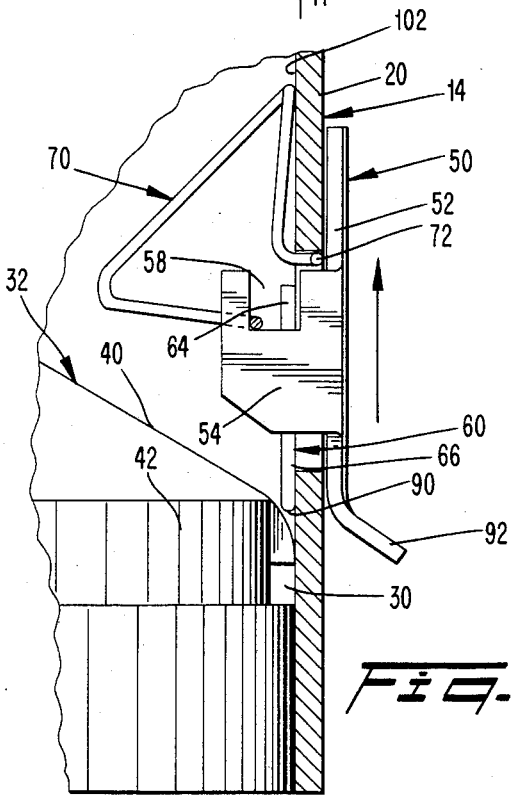
Fig. 9

SAFETY CAP FOR A PRESSURIZED CYLINDER

BACKGROUND AND OBJECTS OF THE INVENTION

The present invention relates to pressurized cylinders and, in particular, to protective caps for pressurized cylinders.

Cylinders containing pressurized fluids, such as oxygen and flammable gases for example, are provided at one end with a valved discharge opening. Protection of the valve is of major concern because a rupturing of the valve (resulting for example from a severe impact) may produce serious harm since the cylinders are highly pressurized (e.g., cylinders commonly in use are pressurized to 5,000 psi). For that reason, it has been necessary to provide a rugged protective cap which fits atop the cylinder in overlying relation to the valve. Virtually all such caps presently in use are formed of steel and are attached to the cylinder by means of a threaded coupling (e.g., female threads on the cap which screw onto male threads on the cylinder).

While such caps have been able to meet minimum safety standards, the threaded coupling presents certain drawbacks. For example, the threads tend to rust and corrode, especially when used in corrosive atmospheres (e.g., when used offshore), Also, in the event that a cylinder is subjected to a severe impact, the threads may become distorted. In such instances, removal of the cap may become very difficult, if not impossible to achieve. It is not uncommon under such circumstances for operators to harshly handle the cylinder (e.g., by striking the cap) in attempting to break loose the threads. Such abuse can lead to a rupturing of the valve. Furthermore, since the male threads are often carried on a ring or collar fastened to the cylinder (e.g., by peening) it is possible that attempts to free a rusted thread may cause the ring to become dislodged from the cylinder, whereupon the ring remains attached to the cylinder, but is free to rotate. In that event, removal of the cap becomes virtually impossible and the cylinder is rendered unusable.

Even in cases where rusted caps are eventually removed without a rupturing of the valve, the difficulty encountered usually produces substantial mounts of wasted time and effort on the part of handlers.

Efforts to design a threadless coupling have heretofore not meet with commercial success due, in large measure, to the inability of such couplings to meet the safety standards required of the caps. For example, the integrity of cap securement is tested by (1) dropping the capped end of the cylinder from ten feet onto cement in a vertical direction and also in a direction oriented at a 45 degree angle to vertical, and (2) toppling a standing cylinder such that the cap impacts against another cylinder lying on the ground whereby the cap of the falling cylinder takes the full impact in a direction generally perpendicular to the cylinder axis. Such impacts can be of considerable magnitude, since the cylinders can be quite heavy, e.g., on the order of 200 pounds for example.

It has heretofore been proposed in Wayer et al U.S. Pat. No. 1,948,953 issued Feb. 27, 1934 to shorten the time required to install and remove the cap by employing a coupling comprising lugs on the cylinders which, upon subsequent rotation of the cap, become wedged against corresponding lugs on the cap. Such an arrangement which constitues, in effect, a shortening of the extent of the standard threaded coupling between the cap and cylinder, presents certain shortcomings. For example, the wedging engagement between the lugs renders the lugs highly susceptible to being locked shut, e.g., by rust, dirt, deformation of the lugs. This possibility is apparently recognized by Wayer et al who provide a hole at the top of the cap for receiving a bar wrench to enable the cap to be rotated.

Also, in such an arrangement, the location of the cap lugs at the very bottom of the cap renders the cap more susceptible to stress failure because there is no material of the cap supporting the cap from below.

It is, therefore, an object of the present invention to minimize or obviate problems of the type discussed above.

Another object is to provide a threadless coupling for pressurized cylinder caps which is easily attachable and releasable.

A further object is to provide such a threadless coupling which satisfies the customary safety standards regarding pressurized cylinder caps.

SUMMARY OF THE INVENTION

These and other objects are achieved by the present invention which relates to a cap securable to a valved end of a pressurized cylinder of the type comprising an end surface, a circumferentially extending groove spaced longitudinally and radially inwardly from the end surface so as to be defined by first and second longitudinal surfaces, and a plurality of longitudinal channels extending from the end surface and into the groove at a location spaced longitudinally from the open end. The cap includes a wall forming a closed end and an open end. The wall includes a generally cylindrical portion disposed adjacent the open end, and a plurality of tabs projecting radially inwardly from an inner face of the cylindrical portion. The tabs are circumferentially elongate and form engagement surfaces facing the closed end. The inner face is sized to fit longitudinally over the end surface. The tabs are spaced circumferentially apart so as to be longitudinally alignable with the channels and to travel longitudinally therealong and into the groove when the cap is inserted longitudinally over the valved end of the cylinder. The tabs have a thickness in the longitudinal direction which is less than the longitudinal distance between the groove-forming first and second surfaces in order to permit the tabs to travel freely circumferentially to a cap securing position between the first and second surfaces in response to forward rotation of the cap about a lingitudinal axis of the cylinder. The cap carries stops limiting rotation of the cap in forward and rearward directions of rotation. The stops include a latch having a manually engageable portion which is accessible from the exterior of the cap, and a latching element disposed interiorly of the cap. The latching element is mounted on the wall for longitudinal movement from a cap releasing position to a cap locking position wherein the latching element enters a recess in the end surface when the cap has been rotated forwardly to the cap securing position for opposing rotation of the cap in the rearward direction.

Preferably, combined effective circumferential lengths of the engagement surfaces of the tab exceed 12 percent of the circumference of the inner face of the cylindrical portion and do not exceed 50 percent thereof.

Preferably, the cap wall is formed of a ductile material, and the tabs are separate from the wall and are mounted in slits in the wall.

It is preferred that the latch be spring-biased toward a cap locking position so that the locking element enters one of the channels in response to forward rotation of the cap.

The stops preferably include a step formed on a trailing end of at least one of the tabs for terminating forward rotation of the cap after the tabs are situated in the cap securing position.

The invention also relates to the combination of the cap with the pressurized cylinder.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which:

FIG. 1 is a side elevational perspective view of a pressurized cylinder containing a safety cap according to the present invention;

FIG. 2 is a perspective exploded view of the cap;

FIG. 8 is a vertical sectional view taken through a cap mounted to the ring and depicting the latch in an upwardly biased position;

FIG. 9 is a fragmentary vertical sectional view taken through the cap, depicting the latch in an upwardly retracted position;

FIG. 10 is a view similar to FIG. 9 depicting the latch after it has been spring-biased downwardly following a forward rotation of the cap;

FIG. 11 is an enlarged, side elevational view of slots through which the latch is mounted to the cap;

DETAILED DESCRIPTION OF A PREFERRED EMBODIMENT OF THE INVENTION

Figure 3:
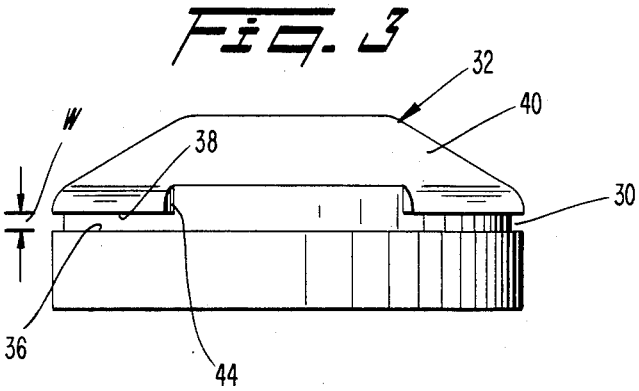
FIG. 3 is a side elevational view of a ring which is to be secured to the pressurized cylinder.
Figure 4:
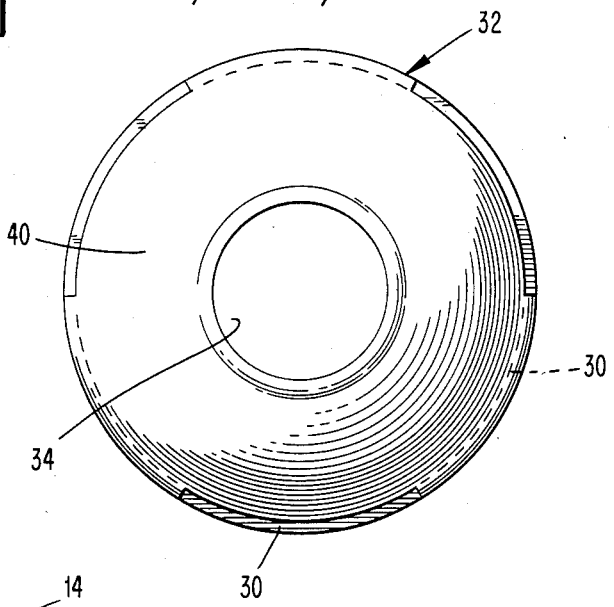
FIG. 4 is a top plan view of the ring of FIG. 3.

Depicted in FIG. 1 is a pressurized cylinder 10 adapted to carry pressurized fluid. Secured to a valved end 12 of the cylinder is a safety cap 14 according to the present invention. The cap is dome-shaped and formed of any suitable material, such as steel for example, which is sufficiently impact-resistant to meet minimum safety standards.

The cap contains vent holes 16 and has an open end 17 sized to fit over the valved end of the cylinder to encompass the valve. Securement of the cap to the cylinder is achieved by means of a quick-release/connect coupling in accordance with the present invention.

That coupling comprises a plurality of tabs 18 which project radially inwardly from a cylindrically shaped inside wall portion 20 of the cap (see FIG. 5) at a location spaced longitudinally from the open end of the cap, e.g., by a distance greater than one-half inch. Each tab 18 is elongate in the circumferential direction, and defines an engagement surface 22, the abutment surfaces 22 lying in a common plane disposed radially, i.e., perpendicularly to a longitudinal axis of the cap. A rear trailing end of each tab includes an offset portion or step 24 which defines a stop. The tabs 18 are configured to be displaceable within an annular, circumferentially extending groove 30 carried by the cylinder 10.

That annular groove 30 can be integrally formed in the cylinder itself or in a separate ring or collar 32 (FIG. 3) which is suitably fixed to the cylinder against rotation relative thereto (e.g., by peening for example). The ring 32 has a central opening 34 through which the valved end of the cylinder 10 projects.

The annular groove 30 is formed by first and second longitudinally spaced annular surfaces 36, 38 whereby the groove is disposed longitudinally inwardly and radially inwardly of a frusto-conical end surface 40 of the ring. The longitudinal spacing between the first and second surfaces 36, 38 defines the groove width W and is slightly larger than the thickness W′ of the tabs (measured exclusively of the step 24) to assure a free sliding movement of the tabs 18 within the groove 30.

Figure 5:
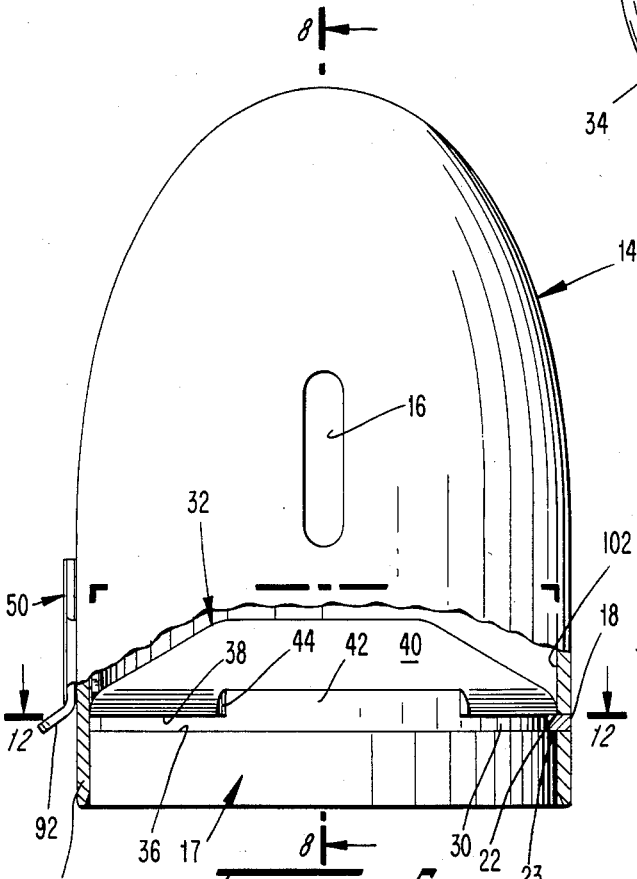
FIG. 5 is a side elevational view of the cap mounted to the ring, with a bottom portion of the cap being broken away.
Figure 14:
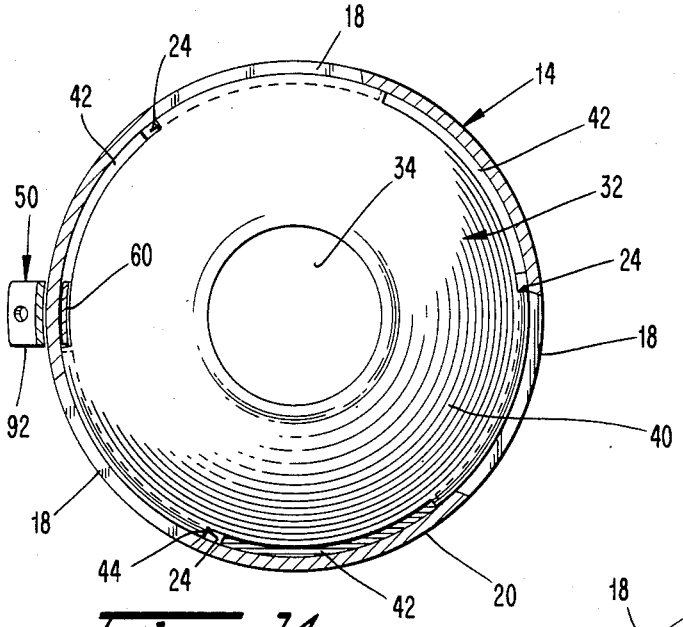
FIG. 14 is a view similar to FIG. 12 after the cap has been fully forwardly rotated to a cap securing position.
Figure 13:
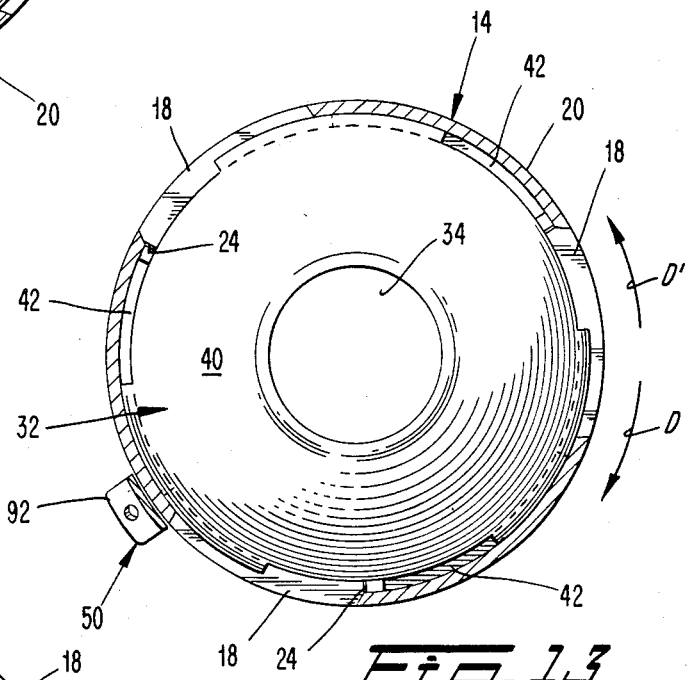
FIG. 13 is a view similar to FIG. 12 after the cap has been partially rotated in the forward direction.
Figure 12:
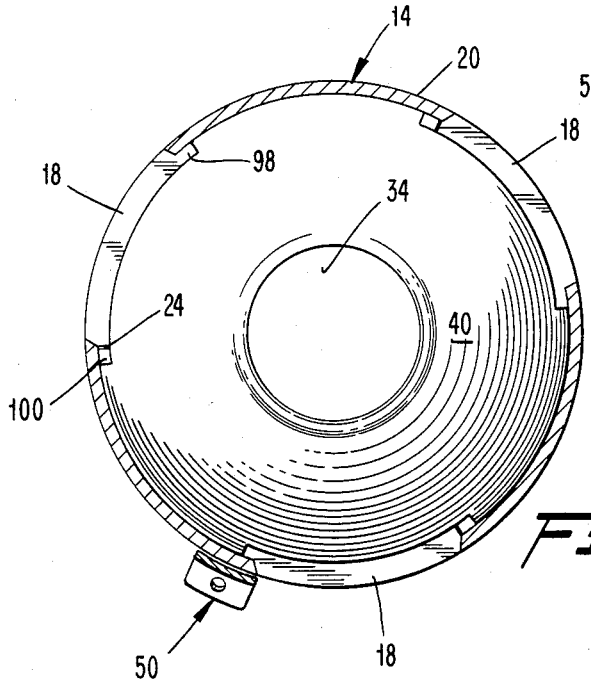
FIG. 12 is a vertical sectional view taken along line 12—12 in FIG. 5 depicting the relationship between the tabs and the groove of the pressurized cylinder just after the tabs have been pushed through the channels and are awaiting forward rotation of the cap.

A plurality of longitudinally extending channels 42 are formed in the end surface. Those channels intersect the groove 30 and are of a circumferential length sufficient to permit the tabs 18 to freely pass therethrough in a longitudinal direction and enter the groove 30 when the cap is inserted longitudinally over the valved end of the cylinder. (FIG. 5). Upon subsequent rotation of the cap in a forward direction D (FIG. 13), the tabs 18 travel to cap-securing positions between the surfaces 36, 38. The steps 24 of the tabs are disposed so as to engage radial walls 44 of the channels to prevent further forward rotation of the cap (see FIG. 14). It will be appreciated that the number and circumferential positioning of the channels corresponds to that of the tabs so that the tabs are alignable with respective ones of the channels.

Carried by the cap 14 is a latch 50 which is arranged to become automatically latched when the cap is in its cap securing position, in order to define a stop which prevents movement of the cap in the rearward direction. The latch 50 comprises a manually engageable slide 52 which is mounted for longitudinal sliding movement relative to the cylindrical portion 20 of the cap 14. The slide 52 includes a pair of parallel legs 54 which project through a pair of longitudinally elongate slots 56 in the cylindrical portion. The legs each include a notch 58 which is open in a direction facing away from the open end 17 of the cap 14.

Mounted on the slide 52 for movement therewith is a latching element 60. The latching element 60 fits between the legs 52 and has a pair of recesses 62 located in edges thereof. The recesses 62 receive the legs 54 so that the latching element 60 is constrained against movement relative to the slide in the longitudinal direction. The upper end of the latching element 60 comprises a pair of lugs 64 disposed within the notches 58, and a lower end of the latching element comprises a pair of lugs 66 disposed beneath bottom edges 67 of the legs 54. Those bottom edges have uwpardly inclined bevels 68 to facilitate mounting of the latching element onto the legs. The latching element is retained on the legs by means of a spring 70 which also serves the additional function of yieldably biasing the latch downwardly.

The spring 70 is in the form of a bent wire having free ends 72 extending through respective ones of the slots 56 and bent toward one another so as to be disposed externally of a web 73 (FIG. 2) situated between the slots. The web 73 is of reduced thickness at its upper end 74 in order to receive the bent ends 72.

From each of the bent ends 72 the spring wire extends upwardly at 76 away from the slots 56, then laterally outwardly and downwardly at 78, then laterally inwardly and downwardly at 80 toward the legs 54 and through the notches 58 and then united to form a U-shaped projection 82 disposed between the legs 54 and adjacent the latching element. The latter can thus not become dislodged from the slide, and the slide is biased downwardly by the portions of the spring extending through the notches 58.

It will be appreciated that the spring is symmetrical about a vertical bisector line B. As a result, even if one side of the spring wire should break, the other side thereof will continue to function.

The latch is disposed slightly circumferentially beyond the leading end of one of the tabs, i.e., the tab 18A in FIG. 2. Accordingly, it is impossible for the latch to enter any of the channels 42 in the ring 32 when the cap 14 is inserted longitudinally onto the ring. Rather, as the cap is inserted such that the tabs pass longitudinally through the channels 42, the bottom edge 90 of the latching element will engage the end surface 40 of the ring, and the latch will thus become displaced longitudinally upwardly, against the bias of the spring 70 as depicted in FIG. 9. As the cap 14 is subsequently forwardly rotated, the latching element 60 will ride along the end surface 40 until becoming aligned with the next channel 42, whereupon the latching element will be biased longitudinally downwardly into that channel 42 by the spring (see FIG. 10). Accordingly, rotation of the cap in the rearward direction D' (FIG. 13) is prevented by the latching element 60 until the slide 52 is slid manually upwardly to displace the latching element from its cap-locking position within the channel to a cap release position.

The slide 52 includes an outward finger 92 which facilitates manual actuation. In that regard, the finger 92 is located closely adjacent the open end 17 of the cap 14 to facilitate actuation by the operator. An operator attempting to turn the cap in a direction for releasing same would normally grip the cap at the lower end, i.e., the end with the widest diameter. In so doing, the operator can simultaneously place the palm of one hand over the projection and exert a turning force on the cap while simultaneously pushing upwardly against the finger 92. Hence, the cap 14 can be unlocked an rotated in one continuous motion.

The tabs 18 can be formed as an integral part of the inside surface of the cap, but more preferably comprise separate elements inserted into circumferentially elongate slits 94 in the cylindrical portion 20 of the cap. The tabs are preferably secured to the cap wall by spot welds at the ends of the tabs in order to assure that the tabs cannot become separated from the cap. The remaining portion of the tab is not welded to the cap. As a result, the tabs are more resistant to failure as the result of cracking. That is, if the tabs comprised an integral part of the cap, the corner where the cap wall 20 meets the upper and lower surfaces 22, 23 of the tab would constitute structurally weak regions susceptible to failure in response to heavy impacts. However, by making the tabs separate from the cap, longitudinal forces applied to the surfaces 22, 23 of the tabs are absorbed by deformation of the walls of the slits 94. Tests have demonstrated that, due to the relative ductility of the steel cap, the slit walls are deformable under heavy loads in order to absorb much of the loading. Hence, the tabs are much less susceptible to shear failure.

Figure 6:
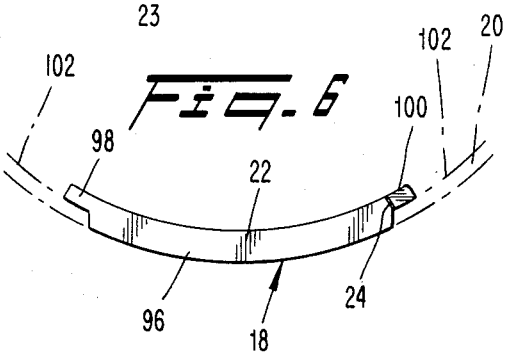
FIG. 6, is a plan view of a tab which is to be mounted on the cap.
Figure 7:
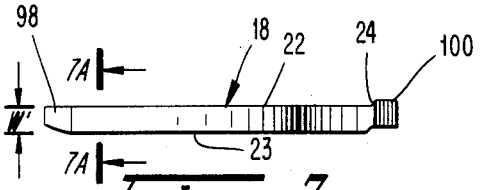
FIG. 7 is a side elevational view of the tab depicted in FIG. 6.

The tabs each include a radially outer portion 96 which is of shorter circumferential length than the radially inner portion thereof, whereby the radially inner portion forms ledges 98, 100 at leading and trailing ends thereof. The afore-described stop 24 is formed on the trailing lip 100. The circumferential length of the outer portion 96 corresponds to that of the associated slit 94. The tab is inserted into its slit 94 from the inside of the cap so that the ledges 98, 100 bear against the inner face 102 of the cap (see FIG. 6). The tabs are then bonded in place, e.g., by welding, although it may be feasible to employ a press-fit.

It will thus be appreciated that the radially inner portion of the tab 18 forms the engagement surface 22 which travels below the second groove-forming surface 38 when the cap is secured to the cylinder. The combined effective circumferential lengths of the engagement surfaces of the tabs is more than 12 percent of the circumference of the inner face 102 of the cap but is no greater than 50 percent thereof. It will be appreciated with respect to the embodiment depicted in FIG. 6 that if only the radially outer portions 96 of the tabs are welded to the cap, i.e., the ledges 98,100 are not welded, then the "effective" circumferential length of each tab 18 would exclude the leading edge 98, because that ledge would not, by itself, create resistance forces for preventing longitudinal dislodgement of the cap from the cylinder. The trailing ledge 100 would not constitute the effective circumferential length of the tab because that ledge 100 never travels beneath the upper one 38 of the groove forming surfaces, due to the presence of the stop 24.

When the tabs are in their cap-securing positions, the leading ends of the tabs are disposed beneath the surface 38 of the groove 30, i.e., that leading end does not project into the next adjacent channel 42.

Figure 7A:
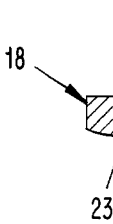
FIG. 7A is a cross-sectional view taken along line 7A–7A of FIG. 7.

It is preferable that at least one of the surfaces 22, 23 of each tab be non-planar, i.e., somewhat convexly curved in any or all directions (e.g., see FIG. 7A) so that any rust or dirt which might form will have a space in which to "escape" when the cap is rotated, thereby minimizing the chances for the tabs to become jammed closed. Such curving of the surface 23 also adds strength to the tabs in its ability to withstand longitudinal forces.

IN OPERATION, the cap 14 is mounted on the cylinder 10 by aligning the radially inner portions of the tabs 18 with the channels 42 carried by the cylinder. The cap is longitudinally inserted, whereupon the tabs 18 travel through the channels 42 and into the annular slot 30. In so doing, the latching element 60 contacts the end surface 40 carried by the cylinder and is displaced upwardly against the bias of the spring 70. Upon subsequent forward rotation of the cap 14, the tabs pass between the surfaces 36, 38 of the groove in order to constrain the cap against longitudinal movement. Forward rotation of the cap continues until the step 42 engages the surface 44 of the channel. At that time, the latching element 60 will overlie the next channel 42 and will be pushed into such channel by the spring 70. As a result, the cap will be constrained against rearward rotation.

To remove the cap, an operator applies an upward force to the slide 52 of the latch in order to raise the latching element out of channel 42, and simultaneously exerts a rearward rotation to the cap to bring the tabs into alignment with the channels. At that time, the cap can be longitudinally lifted from the channel.

It will be appreciated that the present invention avoids the need for screw threads which can become rusted or otherwise jammed to resist removal of the cap. The relatively loose connection between the tabs and the surfaces 36, 38 of the groove 30 minimize the chances for any type of rusting or deformation of the tabs to occur which would prevent removal of the cap. Even if rusting does occur, the rust particles which are created upon rotation of the cap are able to escape from the inner face between the tabs and the surfaces 36, 38, since the tabs are of limited circumferential dimension. Escape of the rust is also facilitated by the curved shape of the surface 23 of the tab and by the above-noted loose fit.

The fact that the tabs are not integral with the cap makes the tabs more shock resistant, since there is no integral corner formed between the tab and the inner wall of the cap which would be particularly susceptible to stress-induced fracture.

Although the present invention has been described in connection with a preferred embodiment thereof, it will be appreciated by those skilled in the art that modifications, substitutions, additions and deletions not specifically described, may be made, without departing from the spirit and scope of the invention as defined in the appended claims.

What is claimed is:

1. A pressurized cylinder having a cap mounted on a valved end of said cylinder; said cylinder carrying a longitudinally facing end surface at said valved end and circumferentially extending groove means formed longitudinally inwardly and radially inwardly of said end surface so as to be defined by first and second circumferentially extending, longitudinally spaced annular surfaces; a plurality of circumferentially spaced channels formed in said end surface and extending longitudinally to intersect said groove means; said cap including a wall forming a closed end and an open end; said wall including a generally cylindrical portion disposed adjacent said open end, and a plurality of tabs projecting radially inwardly from an inner face of said cylindrical portion at a location spaced longitudinally from said open end of said cap; said tabs being circumferentially elongate and forming engagement surfaces facing said closed end; said inner face sized to fit longitudinally over said end surface; said tabs being spaced circumferentially apart so as to be longitudinally alignable with said channels and to travel longitudinally therealong and into said groove means when said cap is inserted longitudinally over said valved end; said tabs being movable circumferentially to a cap-securing position between said first and second surfaces in response to forward rotation of said cap about a longitudinal axis of said cylinder; said tabs having a thickness in the longitudinal direction which is less than the longitudinal distance between said first and second surfaces so as to be freely disposed between said first and second surfaces in said cap-securing position; said cap carrying stop means limiting rotation of said cap in forward and rearward directions of rotation; said stop means including a latch having a manually engageable portion accessible from the exterior of said cap, and a latching element disposed interiorly of said cap; said latching element being mounted on said wall for movement from a cap-releasing position to a cap-locking position wherein said latching element enters a recess in said end surface when said cap has been rotated forwardly to said cap-secured position for opposing rotation of said cap in said rearward direction; the combined effective circumferential lengths of said engagement surfaces of said tabs exceeding 12 percent of the circumference of said inner face of said cylindrical portion and not exceeding 50 percent thereof.

2. Apparatus according to claim 1, wherein said cap wall is formed of a ductile material, said tabs being separate from said wall and mounted in slits in said wall.

3. Apparatus according to claim 1 including a spring biasing said latch toward said cap-locking position, said latching element arranged to engage said end surface and be retracted longitudinally in response to such engagement against the bias of said spring until becoming aligned with said recess following forward rotation of said cap.

4. Apparatus according to claim 1, wherein said recess into which said latching element projects comprises one of said channels.

5. Apparatus according to claim 1, wherein said latching element is situated adjacent a leading end of one of said tabs.

6. Apparatus according to claim 1, wherein said manually engageable portion of said latch includes a generally radially outwardly projecting finger disposed closely adjacent said open end of said cap.

7. Apparatus according to claim 6, wherein said manually actuable portion projects through a longitudinally elongate slot in said wall.

8. Apparatus according to claim 1, wherein said stop means includes a step on a trailing end of at least one of said tabs for terminating forward rotation of said cap after said tabs are situated in said cap-securing position.

9. Apparatus according to claim 1, wherein said latching element is removable from said manually engageable portion, a spring being provided for biasing said manually engageable portion toward said cap-securing position and for retaining said latching element on said manually engageable portion.

10. Apparatus according to claim 1 including spring means biasing said latch to said cap-locking position, said locking element arranged to engage said end surface and be longitudinally retracted against the bias of said spring until becoming aligned with said recess following forward rotation of said cap, said recess comprising one of said channels, said latching element disposed adjacent a leading end of one of said tabs, said manually engageable portion projecting through a longitudinally elongate slot in said wall and including a generally radially outwardly projecting finger situated adjacent said open end, said stop means including a step on a trailing end of at least one of said tabs for terminating forward rotation of said cap after said tabs are situated in said cap-securing positions.

11. A cap securable to a valved end of a pressurized cylinder of the type comprising an end surface, circumferentially extending groove means spaced longitudinally inwardly and radially inwardly from said end surface so as to be defined by first and second longitudinally spaced surfaces, and a plurality of longitudinal channels extending from said end surface and into said groove means; said cap including a wall forming a closed end and an open end; said wall including a generally cylindrical portion disposed adjacent said open end, and a plurality of tabs projecting radially inwardly from an inner face of said cylindrical portion at a location spaced longitudinally from said open end; said tabs being circumferentially elongate and forming engagement surfaces facing said closed end; said inner face sized to fit longitudinally over said end surface; said tabs being spaced circumferentially apart so as to be longitudinally alignable with said channels and to travel longitudinally therealong and into said groove means when said cap is inserted longitudinally over said valved end; said tabs being movable circumferentially to a cap-securing position between said first and second surfaces in response to forward rotation of said cap about a longitudinal axis of said cylinder; said tabs having a thickness in the longitudinal direction which is less than the longitudinal distance between said first and second surfaces so as to be freely disposed between said first and second surfaces in said cap-securing position; said cap carrying stop means limiting rotation of said cap in forward and rearward directions of rotation; said stop means including a latch having a manually engageable portion accessible from the exterior of said cap, and a latching element disposed interiorly of said cap; said latching element being mounted on said wall for movement from a cap-releasing position to a cap-locking position wherein said latching element enters a recess in said end surface when said cap has been rotated forwardly to said cap-secured position for opposing rotation of said cap in said rearward direction; the combined effective circumferential lengths of said engagement surfaces of said tabs exceeding 12 percent of the circumference of said inner face of said cylindrical portion and not exceeding 50 percent thereof.

12. A cap according to claim 11, wherein said cap wall is formed of a ductile material, said tabs being separate from said wall and mounted in slits in said wall.

13. A cap according to claim 11, wherein said latch is yieldably spring-biased toward said cap-locking position.

14. A cap according to claim 11, wherein said stop means comprises a step on a trailing end of at least one of said tabs for terminating forward rotation of said cap after said tabs are situated in said cap-securing position.

15. A cap securable to a valved end of a pressurized cylinder of the type comprising an end surface, circumferentially extending groove means spaced longitudinally inwardly and radially inwardly from said end surface so as to be defined by first and second longitudinally spaced surfaces, and a plurality of longitudinal channels extending from said end surface and into said groove means, said cap including a wall formed of a ductile material and forming a closed end and an open end; said wall including a plurality of tabs formed separately of said cap and mounted in slits formed in said wall and projecting radially inwardly from an inner face of said cylindrical portion at a location spaced longitudinally from said open end; said tabs being circumferentially spaced apart so as to be longitudinally alignable with said channels and to travel longitudinally threalong and into said groove means when said cap is inserted longitudinally over said valved end; said tabs being movable circumferentially to a cap-securing position between said first and second surfaces in response to forward rotation of said cap about a longitudinal axis of said cylinder; said tabs having a thickness in the longitudinal direction which is less than the longitudinal distance between said first and second surfaces so as to be freely disposed between said first and second surfaces in said cap-securing position; said cap carrying stop means limiting rotation of said cap in forward and rearward directions of rotation; said stop means including a latch having a manually engageable portion accessible from the exterior of said cap, and a latching element disposed interiorly of said cap; said latching element being mounted on said wall for movement from a cap-releasing position to a cap-locking position wherein said latching element enters a recess in said end surface when said cap has been rotated forwardly to said cap-secured position for opposing rotation of said cap in said rearward direction.

16. A cap according to claim 15, wherein said latch is yieldably spring-biased toward said cap-locking position.

17. A cap according to claim 15, wherein said stop means comprises a step on a trailing end of at least one of said tabs for terminating forward rotation of said cap after said tabs are situated in said cap-securing position.

18. A pressurized cylinder having a cap mounted on a valved end of said cylinder; said cylinder carrying a longitudinally facing end surface at said valved end and circumferentially extending groove means formed longitudinally inward and radially inwardly of said end surface so as to be defined by first and second circumferentially extending, longitudinally spaced annular surfaces; a plurality of circumferentially spaced channels formed in said end surface and extending longitudinally to intersect said groove means; said cap including a wall formed of a ductile material and forming a closed end and an open end; said wall including a plurality of tabs formed separately of said cap and mounted in slits formed in said wall and projecting radially inwardly from an inner face of said cylindrical portion at a location spaced longitudinally from said open end; said tabs being circumferentially elongate and forming engagement surfaces facing said closed end; said inner face sized to fit longitudinally over said end surface; said tabs being spaced circumferentially apart so as to be longitudinally alignable with said channels and to travel longitudinally therealong and into said groove means when said cap is inserted longitudinally over said valved end; said tabs being movable circumferentially to a cap-securing position between said first and second surfaces in response to forward rotation of said cap about a longitudinal axis of said cylinder; said tabs having a thickness in the longitudinal direction which is less than the longitudinal distance between said first and second surfaces so as to be freely disposed between said first and second surfaces in said cap-securing positoin; said cap carrying stop means limiting rotation of said cap in forward and rearward directions of rotation; said stop means including a latch having a manually engageable portion accessible from the exterior if said cap, and a latching element disposed interiorly of said cap, said latching element being mounted on said wall for movement from a cap-releasing position to a cap-locking position wherein said latching element enters a recess in said end surface when said cap has been rotated forwardly to said cap-secured position for opposing rotation of said cap in said rearward direction.

19. A cap according to claim 18, including a spring yieldably spring-biasing said latch toward said cap-locking position.

20. A cap according to claim 19, wherein said spring comprises a bent wire which is symmetrical about a bisecting plane.

21. A cap according to claim 18, wherein said stop means comprises a step on a trailing end of at least one of said tabs for terminating forward rotation of said cap after said tabs are situated in said cap-securing position.

* * * * *